US006161467A

United States Patent [19]

A'Hearn et al.

[11] Patent Number: 6,161,467

[45] Date of Patent: Dec. 19, 2000

[54] FLUID CONTROL SYSTEM WITH REGENERATION

[75] Inventors: Michael A. A'Hearn, Shorewood; Thomas J. Hajek, Jr., Lockport; Tony L. Marcott, Peoria; Srikrishnan T. Tolappa, Aurora, all of Ill.

[73] Assignee: Caterpillar Inc., Peoria, Ill.

[21] Appl. No.: 09/275,153

[22] Filed: Mar. 24, 1999

[51] Int. Cl.[7] ..... F15B 11/024

[52] U.S. Cl. ..... 91/436; 91/441; 91/447

[58] Field of Search ..... 91/436, 437, 441, 91/447

[56] References Cited

U.S. PATENT DOCUMENTS

| | | | |
|---|---|---|---|
| 3,228,306 | 1/1966 | Pedersen | 91/436 |
| 3,262,467 | 7/1966 | Stacy | 91/436 |
| 3,273,468 | 9/1966 | Allen | 91/436 |
| 4,024,798 | 5/1977 | Schexnayder et al. | 91/436 |
| 4,028,889 | 6/1977 | Budzich . | |
| 4,204,459 | 5/1980 | Johnson | 91/447 |
| 4,958,553 | 9/1990 | Ueno | 91/447 |
| 5,370,038 | 12/1994 | Poppe et al. | 91/436 |

*Primary Examiner*—F. Daniel Lopez
*Attorney, Agent, or Firm*—Haverstock, Garrett & Roberts; J. W. Burrows

[57] ABSTRACT

A fluid control system including a control valve providing a simple, easy to use regeneration capability in association with a pump, a tank, and a double acting actuator having a first actuating chamber and a second actuating chamber. The control valve has a first actuating chamber port connected to the first actuating chamber, a second actuating chamber port connected to the second actuating chamber, a tank port connected to the tank, a first pump port and a second pump port. The control valve includes a connecting passage connecting the first pump port and the second pump port to the pump, and is operable in a first position to allow fluid flow from the pump through the first pump port and the first actuating chamber port to the first actuating chamber and fluid flow from the second actuating chamber through the second actuating chamber port and the tank port to the tank. For regeneration, the control valve member is movable from the first position to a second position to allow the fluid flow from the second actuating chamber port to be diverted to the second pump port such that the fluid flow can pass through the connecting passage to the first pump port and through the first actuating chamber port to the first actuating chamber of the actuator.

5 Claims, 1 Drawing Sheet

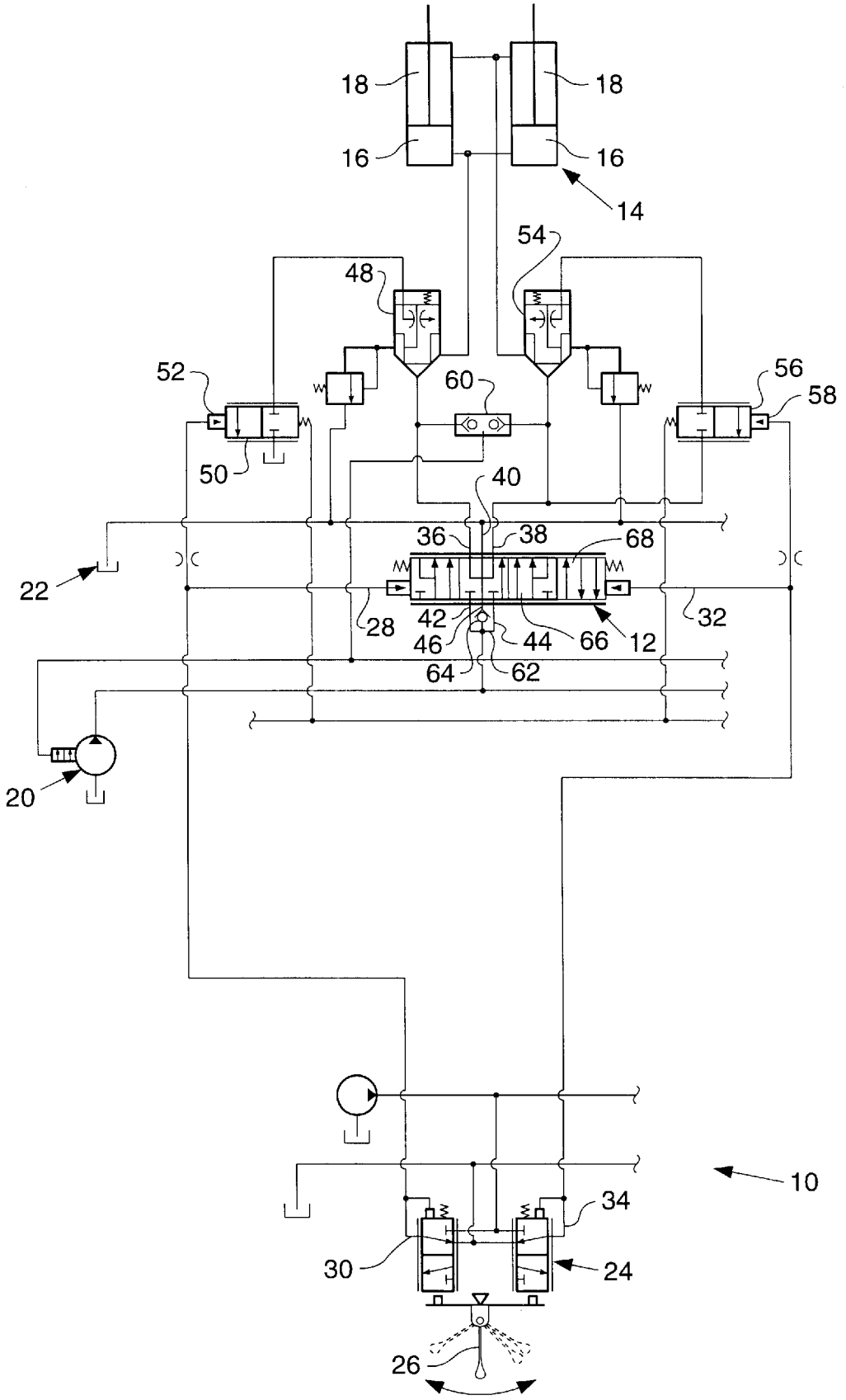
18
18
16
16
14
54
48
52
60
56
58
50
40
36
38
68
22
28
42
46
44
66
12
32
64
62
20
10
34
30
24
26

FLUID CONTROL SYSTEM WITH REGENERATION

TECHNICAL FIELD

This invention relates generally to a fluid control system for a bucket of a loader or the like, and more particularly, to a fluid control system having a control valve providing a simple, easy to use regeneration capability.

BACKGROUND ART

Fluid control systems including a regeneration capability, that is, the ability to direct some of the fluid exhausted from a contracting chamber of a double acting actuator to an expanding chamber thereof to provide an extension speed greater than that provided by pump flow only, are well known. One common type of regeneration valve is disposed between the main directional control valve and the actuator to provide a quick drop feature for actuators driven in one direction by gravity loads. One of the problems associated with having a regeneration valve between the main control valve and the actuator is that the operator has little or no control over the amount of regenerated fluid recirculated from the contracting chamber to the expanding chamber. Moreover, such regeneration valves are frequently triggered to their regeneration position automatically when the flow rate of the fluid expelled from the contracting chamber exceeds a predetermined flow rate such that regeneration takes place only under certain operating conditions.

Reference Poppe et al U.S. Pat. No. 5,370,038 issued Dec. 6, 1994 to Caterpillar Inc., which discloses a remotely controlled regeneration circuit for a hydraulic system utilizing a directional control valve and a separate, remotely controlled regeneration valve. However, providing a separate regeneration valve is a generally expensive and complex alternative.

Accordingly, the present invention is directed to overcoming one or more of the problems as set forth above.

DISCLOSURE OF THE INVENTION

In one aspect of the present invention, a fluid control system including a control valve providing a simple, easy to use regeneration capability in association with a pump, a tank, and a double acting actuator having a first actuating chamber and a second actuating chamber is disclosed. The control valve has a first actuating chamber port connected to the first actuating chamber, a second actuating chamber port connected to the second actuating chamber, a tank port connected to the tank, a first pump port and a second pump port. The control valve includes a connecting passage connecting the first pump port and the second pump port to the pump, and is operable in a first position to allow fluid flow from the pump through the first pump port and the first actuating chamber port to the first actuating chamber and fluid flow from the second actuating chamber through the second actuating chamber port and the tank port to the tank. For regeneration, the control valve member is movable from the first position to a second position to allow the fluid flow from the second actuating chamber port to be diverted to the second pump port such that the fluid flow can pass through the connecting passage to the first pump port and through the first actuating chamber port to the first actuating chamber of the actuator.

BRIEF DESCRIPTION OF THE DRAWINGS

FIG. 1 is a schematic illustration of an embodiment of the present invention.

BEST MODE FOR CARRYING OUT THE INVENTION

A fluid control system 10 including a control valve 12 providing a regeneration capability constructed and operable according to the teachings of the present invention is shown. System 10 includes a double acting hydraulic actuator 14 having a pair of first actuating chambers 16 and a pair of second actuating chambers 18. Actuator 14 is representative of a wide variety of hydraulic cylinders used for such purposes as, but not limited to, tilting a bucket of a loader or other work machine (not shown). System 10 includes a hydraulic pump 20, a tank 22, and an operator controlled pilot actuator valve 24 having a control lever 26.

Control valve 12 is an infinitely variable, pilot signal controlled six way, four position directional control valve having a first pilot signal port 28 connected to a first pilot actuator port 30 of pilot actuator valve 24, and a second pilot signal port 32 connected to a second pilot actuator port 34 of valve 24. Control valve 12 includes a first actuating chamber port 36, a second actuating chamber port 38, a tank port 40, a first pump port 42, a second pump port 44, and a cross over passage connected to the tank port 40. First actuating chamber port 36 is connected to first actuating chamber 16 via a first poppet valve 48 controlled by a first pilot stage control 50 having a pilot signal port 52 connected to first pilot actuator port 30 of pilot actuator valve 24. Second actuating chamber port 38 is connected to second actuating chamber 18 of actuator 14 through a second poppet valve 54 controlled by a second pilot stage control 56 having a pilot signal port 58 connected to second pilot actuator port 34 of pilot actuator valve 24. Pilot stage controls 50 and 56 are operable in the conventional manner under control of pilot signals received from pilot actuator valve 24 for controlling fluid flow from the respective actuating chambers 16 and 18. A fluid resolver 60 is connected between poppet valves 48 and 54 for resolving a load control signal generated thereby to be communicated to other locations, such as to pump 20, as is well known in the art. First pump port 42 and second pump port 44 are connected to pump 20 via a connecting passage 62 which also connects to cross over tank passage 46 via a one-way check valve 64 operable to allow make-up flow from the tank part 40 via the cross over passage 46 to connecting passage 62, but not from connecting passage 62 to cross over passage 46.

Control valve 12 has a neutral position as shown wherein pilot signals on pilot signal ports 28 and 32 are generally equal such that first and second actuating chamber ports 36 and 38 are connected together. Control valve 12 is movable to a position to the left of the neutral position by a pilot signal on signal port 28 such that fluid flow from pump 20 is allowed through pump port 44 and second actuating chamber port 38 to second poppet valve 54. The fluid can then flow through poppet valve 54 to second actuating chamber 18 of actuator 14. At the same time, the pilot signal is present on signal port 52 of control 50 to allow poppet valve 48 to open and allow flow from first actuating chamber 16 to first actuating chamber port 36 and through control valve 12 to tank port 40. In an application where fluid control system 10 is utilized for controlling the tilt function of a bucket of a loader, this would generally correspond to a rack back position wherein the bucket is tilted to a rack back or generally upwardly open position.

When a required pilot signal is present on signal port 32 of control valve 12, valve 12 is operable to move to a normal dump position 66 immediately to the right of the neutral position of control valve 12 shown, such that fluid flow from pump 20 is allowed through pump port 42 and first actuating chamber port 36 of control valve 12 to poppet valve 48 through which the fluid can pass to enter actuating chamber 16. The signal also appears on signal port 58 of control 56 to allow poppet valve 54 to open, to allow fluid flow from actuating chamber 18 to port 38 of control valve 12. The fluid then passes through valve 12 to tank port 40.

Importantly, control valve 12 is movable to a regeneration position 68 to the right of dump position 66 wherein fluid flow from pump 20 is still allowed from first pump port 42 to first actuating chamber port 36 and through first poppet valve 48 to first actuating chamber 16 of actuator 14, simply by moving lever 26 of pilot actuator valve 24 to increase the existing pilot signal strength or pressure. With control valve 12 in this position, fluid flow from second actuating chamber 18 of actuator 14 is allowed through second poppet valve 54, second actuating chamber port 38 and second pump port 44 to connecting passage 62, wherein the fluid can combine with the flow through first pump port 42 en route to first actuating chamber 16 for providing regeneration. Make up fluid flow, as required, can be provided from the tank port 40 via cross-over passage 46.

INDUSTRIAL APPLICABILITY

The present fluid control system and associated control valve provides a regeneration capability requiring no additional valves, that can be actuated simply by moving a lever of a control lever operable for controlling the control valve past a position for a related function.

Other objects and advantages of the present invention can be obtained from a study of the drawings, the disclosure and the appended claims.

What is claimed is:

1. A fluid control system with a regeneration capability, comprising:

a pump;

a tank;

a double-acting actuator having a first actuating chamber and a second actuating chamber;

a pilot signal controlled directional control valve having a first actuating chamber port connected to the first actuating chamber, a second actuating chamber port connected to the second actuating chamber, a tank port connected to the tank, a first pump port and a second pump port, the control valve including a connecting passage connecting the first pump port and the second pump port to the pump, and being operable in a first position to allow fluid flow from the pump through the first pump port and the first actuating chamber port to the first actuating chamber and fluid flow from the second actuating chamber through the second actuating chamber port and the tank port to the tank, the control valve being movable in response to a pilot signal from the first position to a second position to allow the fluid flow from the second actuating chamber port to be diverted to the second pump port such that the fluid flow passes through the connecting passage to the first pump port and through the first actuating chamber port to the first actuating chamber of the actuator; and a first pilot operated valve disposed between the first actuating chamber port of the directional control valve and the first actuating chamber for controlling fluid flow therebetween, and a second pilot operated valve disposed between the second actuating chamber port of the directional control valve and the second actuating chamber for controlling fluid flow therebetween, each of the first and second pilot operated valves being moved by the pilot signal controlling the directional control valve.

2. The fluid control system of claim 1, including an operator controlled valve movable from a first operative position to an adjacent second operative position for moving the control valve from the first position to the second position and for controlling the respective first and second pilot operated valves.

3. The fluid control valve of claim 1, wherein the double-acting actuator is a tilt actuator for a bucket.

4. The fluid control system of claim 3, wherein the first position of the valve is a dump position for the bucket.

5. A fluid control system with a regeneration capability, comprising:

a pump;

a tank;

a double-acting actuator having a first actuating chamber and a second actuating chamber; and a control valve having a first actuating chamber port connected to the first actuating chamber, a second actuating chamber port connected to the second actuating chamber, a tank port connected to the tank, a first pump port and a second pump port, the control valve including a connecting passage connecting the first pump port and the second pump port to the pump, and being operable in a first position to allow fluid flow from the pump through the first pump port and the first actuating chamber port to the first actuating chamber and fluid flow from the second actuating chamber through the second actuating chamber port and the tank port to the tank, the control valve being movable from the first position to a second position to allow the fluid flow from the second actuating chamber port to be diverted to the second pump port such that the fluid flow passes through the connecting passage to the first pump port and through the first actuating chamber port to the first actuating chamber of the actuator, the control valve includes a passage connecting the tank port and the connecting passage and a check valve operable to allow flow of fluid from the tank port to the connecting passage.

* * * * *